United States Patent [19]

Francino

[11] Patent Number: 4,954,075

[45] Date of Patent: Sep. 4, 1990

[54] LANTERN HEAD FOR BACKPACKER'S STOVE

[76] Inventor: Neal A. Francino, 1641 E. Del Rio, Tempe, Ariz. 85282

[21] Appl. No.: 402,682

[22] Filed: Sep. 5, 1989

[51] Int. Cl.[5] ..... F21H 1/00

[52] U.S. Cl. ..... 431/107; 362/179; 126/39 R

[58] Field of Search ..... 431/107, 103, 106; 126/39 R, 40, 44; 362/179

[56] References Cited

U.S. PATENT DOCUMENTS

| | | | |
|---|---|---|---|
| 2,638,085 | 5/1953 | Guedon | 126/40 |
| 2,664,729 | 1/1954 | Bramming | 431/106 |
| 3,140,740 | 7/1964 | Lagreid et al. | 126/44 |
| 3,586,472 | 6/1971 | Clifton | 362/179 |
| 3,745,328 | 7/1973 | Hissem et al. | 126/44 |
| 3,773,458 | 11/1973 | Spotts | 126/44 |
| 3,804,075 | 4/1974 | Rummel | 126/258 |
| 3,807,938 | 4/1974 | Hastings | 431/107 |
| 4,092,974 | 6/1978 | Zenzaburo | 126/38 |
| 4,177,790 | 12/1979 | Zenzaburo | 126/38 |
| 4,372,198 | 2/1983 | Stover, Jr. et al. | 99/340 |
| 4,572,157 | 2/1986 | Napier | 126/258 |
| 4,646,213 | 2/1987 | Fanelli et al. | 362/180 |
| 4,726,350 | 2/1988 | Steinhauser | 126/38 |

*Primary Examiner*—Carroll B. Dority

*Attorney, Agent, or Firm*—Joseph E. Gerber

[57] ABSTRACT

An inventive lantern head is disclosed for adapting an inverted backpacking stove to lighting use, said lantern head including fuel-burning lighting means within a glass globe, said globe and lighting means both being supported by a surrounding frame. Mounting means for engagement with said inverted backpacking stove's underside depends from beneath said frame. And, said lighting means is fed by a fuel conduit having means at its distal end for attachment to the stove's remote fuel supply and fuel flow regulator.

8 Claims, 4 Drawing Sheets

LANTERN HEAD FOR BACKPACKER'S STOVE

BACKGROUND OF THE INVENTION

1. Field Of The Invention

The present invention relates generally to camping lanterns, and more specifically to small, lightweight lanterns for efficient backpacking.

2. Description Of The Related Art

When engaging in the practice of camping, the accoutrements necessary for providing efficient lighting, cooking and other everyday needs are usually limited. In fact, many find the joy in camping to be in just "getting by" with only the minimum essentials. One way to limit the equipment a camper needs is to provide for "multiple uses" in the equipment's design.

For example, in the bulkier type of camping equipment which is usually not carried very far from the vehicle to the campsite, various add-on devices have been developed to permit a lantern to perform the double duty of lighting and cooking. These are generally adapted for engagement with the rather large and heavy twin mantle "Coleman" -type lantern. (The term "Coleman" is a registered U.S. trademark (®).) One such device is shown in U.S. Pat. No. 3,804,075 issued to Rummel in 1974. Therein, a tubular metal member is disclosed for attachment to such a lantern in place of its draft hood. Said member may support a pot, pan or the like over the lantern to exploit its residual heat.

A related device, for which U.S. Pat. No. 4,572,157 was granted to Napier in 1986, engages the top of a lantern and has outfolding arms to support cooking vessels. And, the disclosure of Stover, Jr., et al., in U.S. Pat. No. 4,372,198 issued in 1983, shows a grill attachment for similar lanterns.

Guedon, in U.S. Pat. No. 2,638,085 issued in 1953, discloses a true dual-purpose lantern-stove device. It has an upper portion that can be raised for function as a lantern, or lowered for function as a stove. Yet, this too is based on the bulky "Coleman" -type lantern Despite the dual-purpose efficiency achieved in the foregoing complex, heavy, bulky devices, these fail to address the needs of that class of campers known as "backpackers." Since backpackers physically carry everything needed for comfortable camping, they find great utility in miniature, ultra-lightweight, versatile, adaptable, multipurpose equipment. The ultimate aim is to minimize both the weight and the size of the backpack's load for more efficient enjoyment of the sport.

In the combined lighting and cooking arts, a device perhaps more adaptable for backpacking is shown in U.S. Pat. No. 4,646,213 issued to Fanelli, et al. in 1987. Therein, a simple ring-like stove adaptor for a wick-type collapsible lantern is disclosed. However, the wick-type lantern of Fanelli, et al. is not the most efficient heat source for cooking.

Backpacking aficionados usually employ flashlights, small headlamps or candles for light, and relegate the separate function of cooking to one of several styles of lightweight, space-efficient stoves. These commonly include a remote fuel supply, the fuel being delivered to the stove through a conduit. Examples of such stoves are found in the patent literature. The device of U.S. Pat. No. 4,726,350 issued to Steinhauser in 1988 employs a compact, wire-legged design able to be packed up into a kit. And, two U.S. Pat. Nos. 4,092,974 and 4,177,790 issued to Zenzaburo in 1978 and 1979, respectively, show a stove of a similar, very trim design. However, the devices of Steinhauser and Zenzaburo burn butane gas, this being considered to be a less versatile, and therefore less desirable, fuel for all-around backpacking. Specifically, butane comes in cartridges which present disposal problems; and, the gas has a foul odor. And, for those braving thermal extremes, butane presents an additional problem as it turns liquid around 0° C. and becomes difficult to ignite for lack of pressure.

Many backpackers agree that, for cooking, a pressurized liquid fuel such as white gas is most versatile and efficient. A white gas-burning stove known a the "WhisperLite" stove manufactured by the Mountain Safety Research ("MSR") Company of Seattle, Washington is one of the most popular backpacker's stoves in use today. The "WhisperLite" has folding wire legs as in Steinhauser and Zenzaburo, above. And, it also draws from a remote fuel supply. But, white gas being the fuel, a different burner head is used, and a priming cup and pre-heat coil are provided. The WhisperLite is particularly durable and reliable, and it is fully serviceable in the field.

"MSR" also offers a stove convertible between use with white gas and kerosene having a structure very similar to its WhisperLite. This is offered under the product name "MSR WhisperLite Internationale."

Regarding relative advantage, the above devices for cooking over a "Coleman" -type lantern comprise a package, including the lantern, too large and heavy for backpacking. Even if the elements were reduced in size and weight to be suitable for the backpack, use of a lantern's residual heat for cooking is inherently impractical. Problems include the need, when adjusting cooking heat, to alter the amount of light coming from the lantern. And, the upper end of the heat range from a lantern is likely to be limited in comparison with a stove. Downsized and compact lanterns, although more suited to backpacking, suffer from the same limitations, as can be seen by examining the wick-type lantern of Fanelli, et al., above. And, as is obvious, the flashlights, headlamps and candles relied upon by backpackers have no cooking capabilities.

Thus, the need exists for practical and efficient apparatus convertible between cooking and lighting uses for backpackers.

SUMMARY OF THE INVENTION

The camp stove lantern head of the present invention is adapted to overcome the above-noted shortcomings and to answer the stated need. The approach is taken that a combination lighting and cooking device may be better based upon the conversion of a stove to lighting capability, rather than converting a lantern for cooking as is the trend in the prior art. The stoves employed in practicing the invention are of the lightweight, backpacking type and are amenable to easy conversion to a lighting device with the aid of the claimed lantern head.

The elements of the inventive lantern head include fuel-burning lighting means within a glass globe, said globe and lighting means both being supported by a surrounding frame. Mounting means for engagement with an inverted backpacking stove's underside depends from beneath said frame. And, the lighting means is fed by a fuel conduit having means at its distal end for attachment to the stove's remote fuel supply and fuel flow regulator.

This lantern head's mounting means is particularly adapted for use with an inverted stove, that is, a backpacking stove with its underside up. Thus, advantage is taken of the fact that an inverted stove of the type preferred forms a very stable base for a lantern. Additionally, engagement with the stove's underside obviates disassembly of its burner head for lantern engagement. And, the fact that it mates with the stove's unique flow-regulated fuel source affords further economy.

Thus, it is an object of the present invention to permit conversion of a backpacking stove to a lantern.

It is a feature of the present invention to provide a lantern head having lighting means, means for engagement with an inverted backpacking stove and means for engagement with the same stove's fuel source and flow regulator thereby saving weight in a backpacker's load.

And, it is an advantage of the present invention to provide lighting apparatus for quick and easy engagement with a backpacking stove.

Yet another advantage of this invention is the provision of a lantern head for use with several of the most popular commercial models of backpacking stoves.

Still further objects, features and advantages of the inventive lantern head disclosed herein will be apparent from the drawings and following detailed description thereof.

DESCRIPTION OF THE PREFERRED EMBODIMENT

Figure 1:
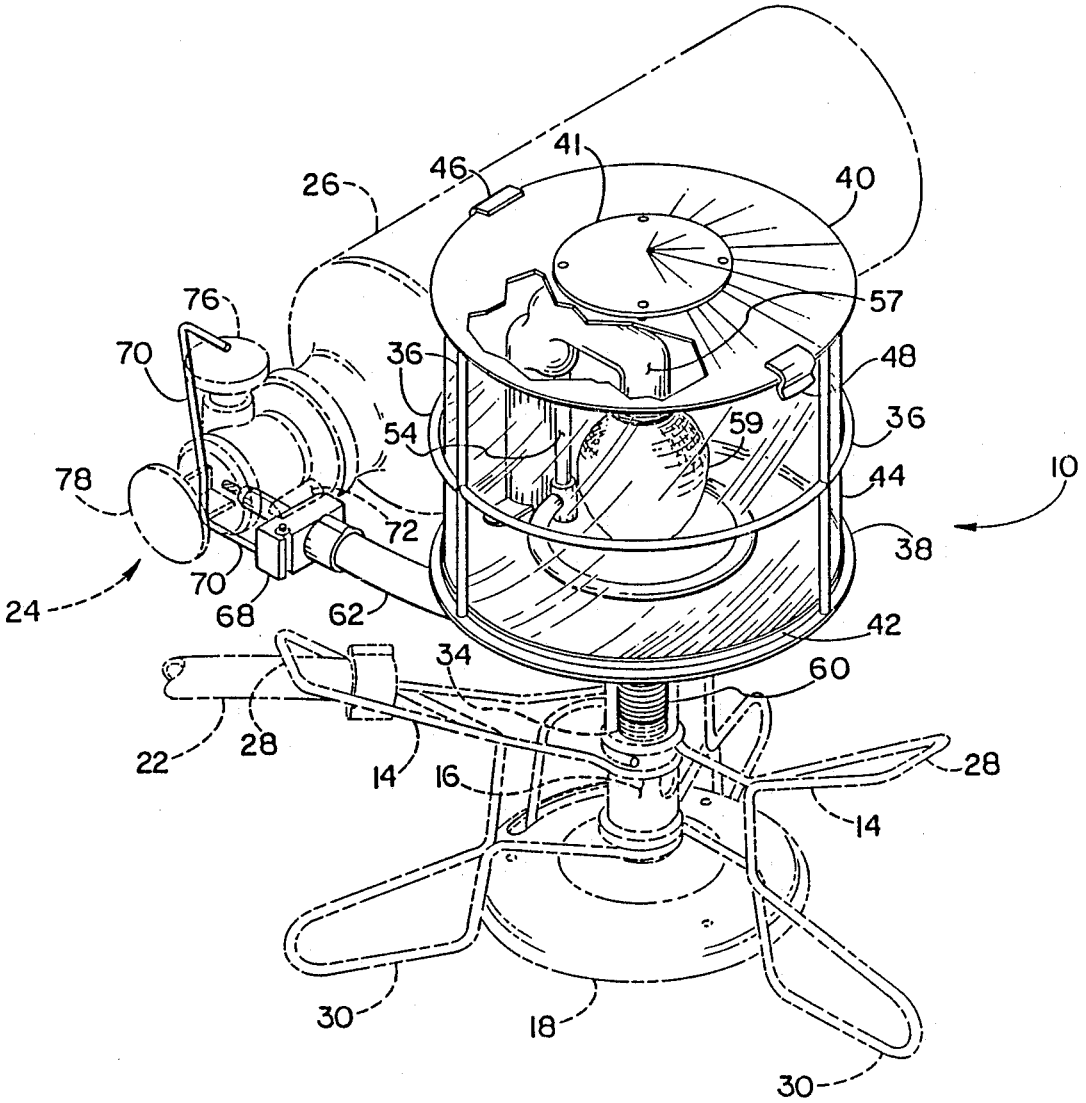
FIG. 1 shows a perspective view of the inventive lantern head engaged with an inverted "MSR WhisperLite" stove and its fuel vessel, said stove and fuel vessel being shown in phantom.
Figure 2:
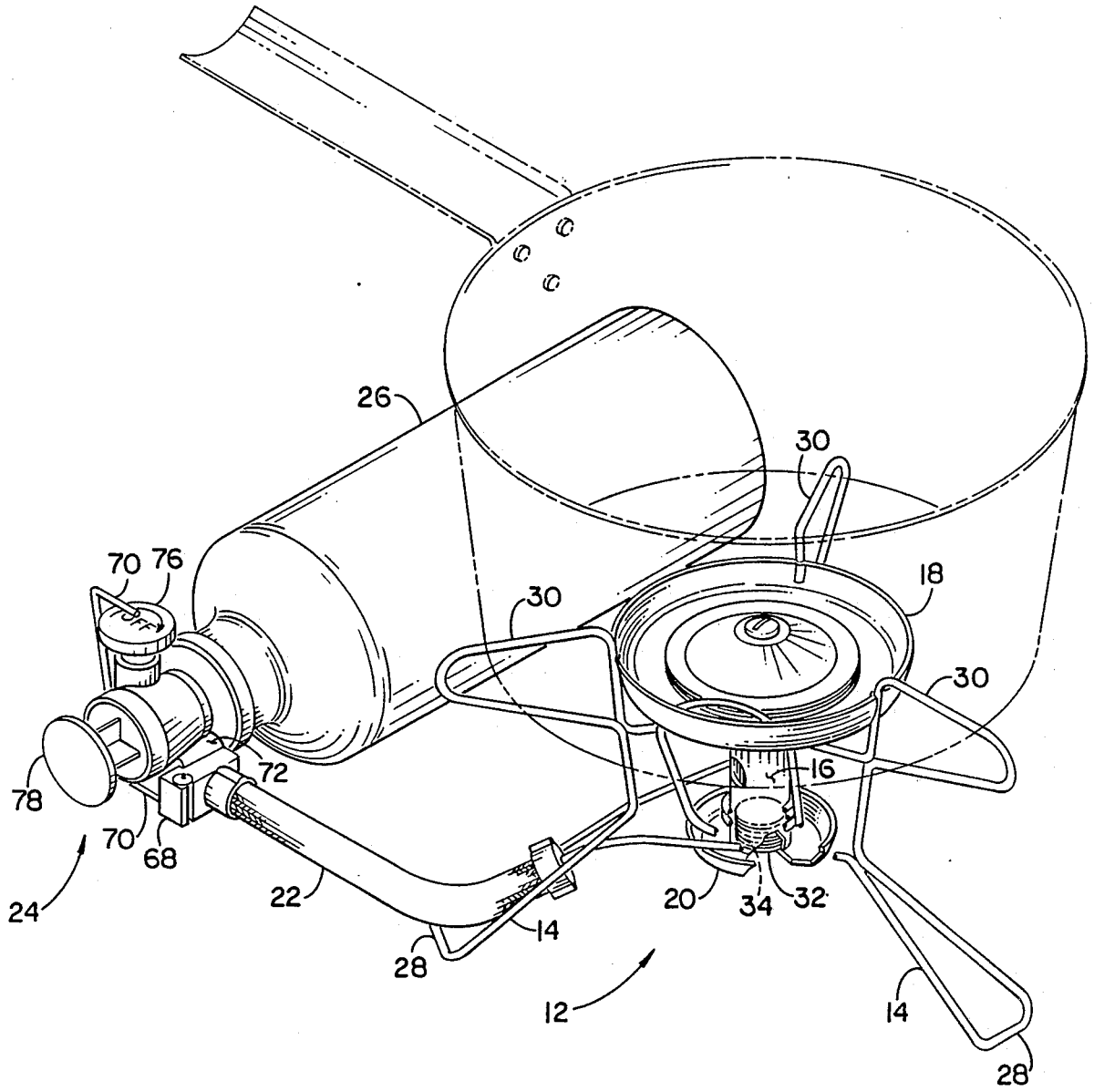
FIG. 2 is a perspective view of the stove of FIG. 1 set up for normal cooking use with a cooking vessel shown thereover in phantom.

Referring now specifically to the drawings, FIG. 1 shows the inventive lantern head 10 engaged for use with an inverted "MSR WhisperLite" backpacking stove 12. The "MSR" stoves, being some of the most popular, are the stoves with which the preferred embodiment of the invention is adapted to mate. Both the "WhisperLite," and the "WhisperLite Internationale," and perhaps others, have outward-extending wire legs 14 supporting a central body 16, with a burner head 18 mounted thereabove and a detachable priming cup 20 below. See, particularly, FIG. 2 showing such a stove in normal use. A fuel conduit 22 runs from the stove to a pump assembly 24, said pump, in turn, being adapted for engagement with a pressurized fuel vessel 26.

Wire legs 14 are shaped to serve two purposes during the stove's normal use. First, feet 28 are fashioned to engage the surface upon which the stove rests, and second, cooking vessel supports 30 at the upper extremes of said legs are adapted to suspend a cooking vessel over burner head 18. Thus, legs 14 provide for particularly stable cooking. And, although not obvious upon examination of the stove when set up for normal use, even when the stove is inverted its stability is retained because cooking vessel supports 30 function surprisingly well as feet.

Once inverted, advantage may be taken of the fact that the stove's priming cup 20 depends from the stove's underside on an axial, threaded stem 32. Cup 20 is easily removed by hand, that is, without tools, to expose a threaded aperture 34. Thus, an inverted stove with its priming cup removed constitutes an unexpectedly stable base ready to receive and support a lighting device. The rest of the stove remains intact.

Lantern head 10 is adapted to engage such an inverted stove for support. The preferred embodiment of lantern head 10 comprises an upright, cylindrical, cage-like frame 36, closed at its ends by lower and upper end plates, 38 and 40, respectively. See, particularly, FIGS. 1, 3, 4, and 5. Frame 36 may be constructed of rigid metal wire, or the like; and, plates 38 and 40 are circular and fashioned of sheet metal. Lower end plate 38 is fixed to frame 36 and includes an upstanding rim 42 for securely receiving the lower end of a cylindrical glass globe 44 of slightly less diameter. Upper plate 40 is adapted for ingress to frame 36's interior and therefore includes a hinge 46 bound to the upper periphery of frame 36 and a clip 48 to retain plate 40 in its horizontal place.

Figure 3:
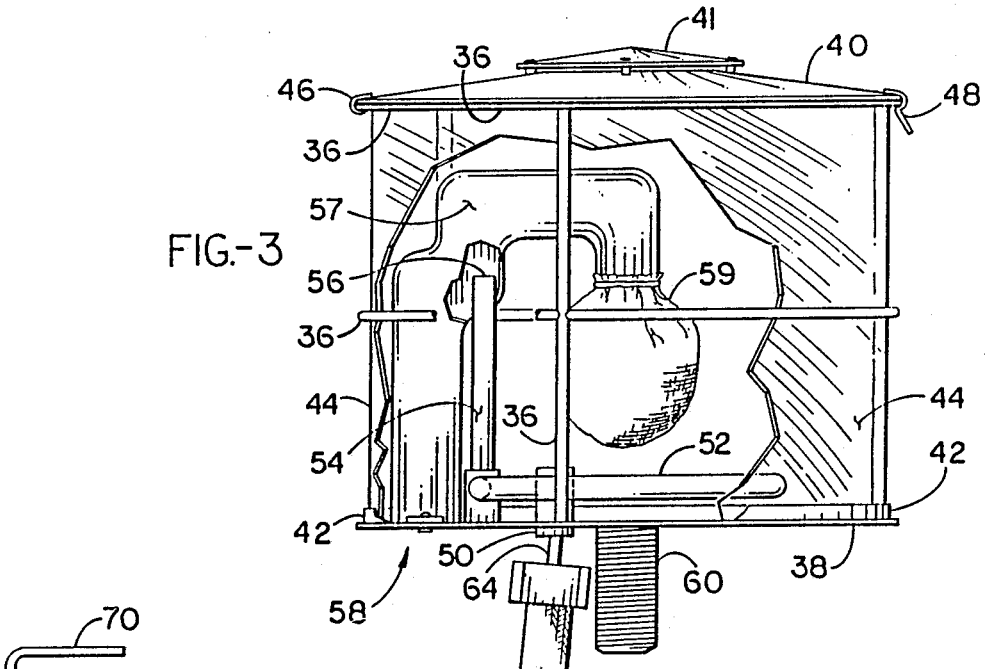
FIG. 3 shows a side elevation of the lantern head of FIG. 1 partially cut away to reveal its mantle and its fuel and air delivery tubes.
Figure 4:
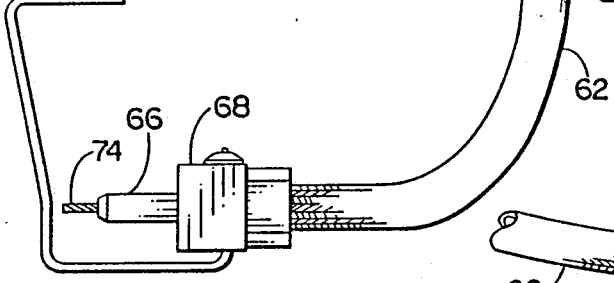
FIG. 4 is a top view of the lantern head of FIG. 3 with its upper end plate partially cut away to reveal the internal elements of the lantern.
Figure 4:
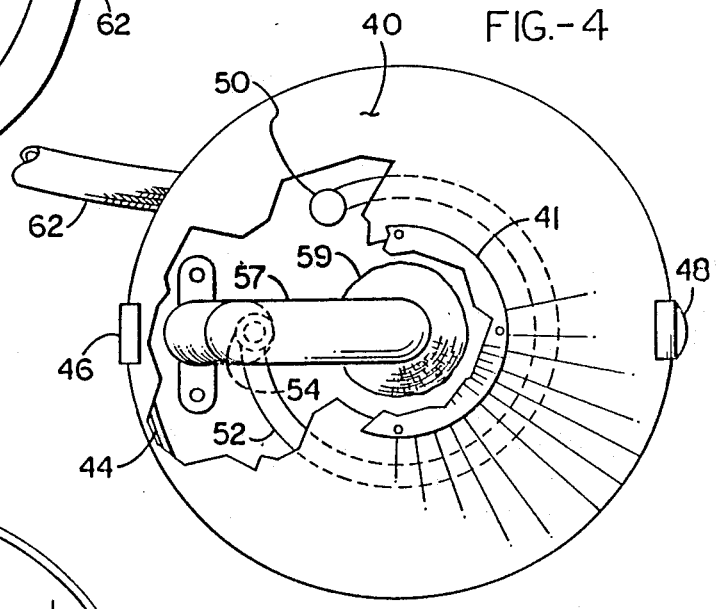
Figure 5:
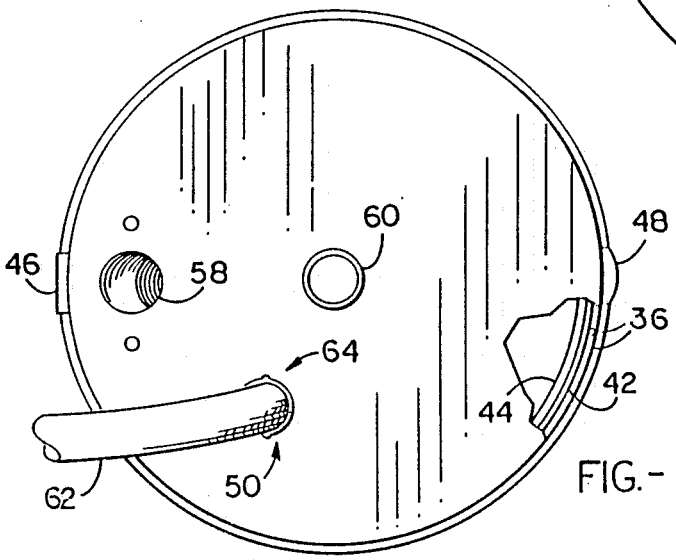
FIG. 5 is a bottom view of the lantern of FIG. 1.
Figure 6:
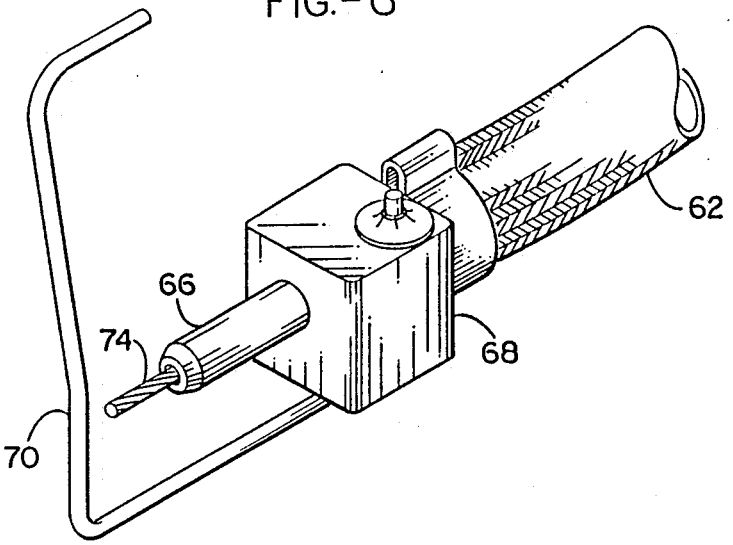
FIG. 6 is an enlarged perspective of the alignment block and swinging catch arm at the distal end of the lantern head's fuel conduit.
Figure 7:
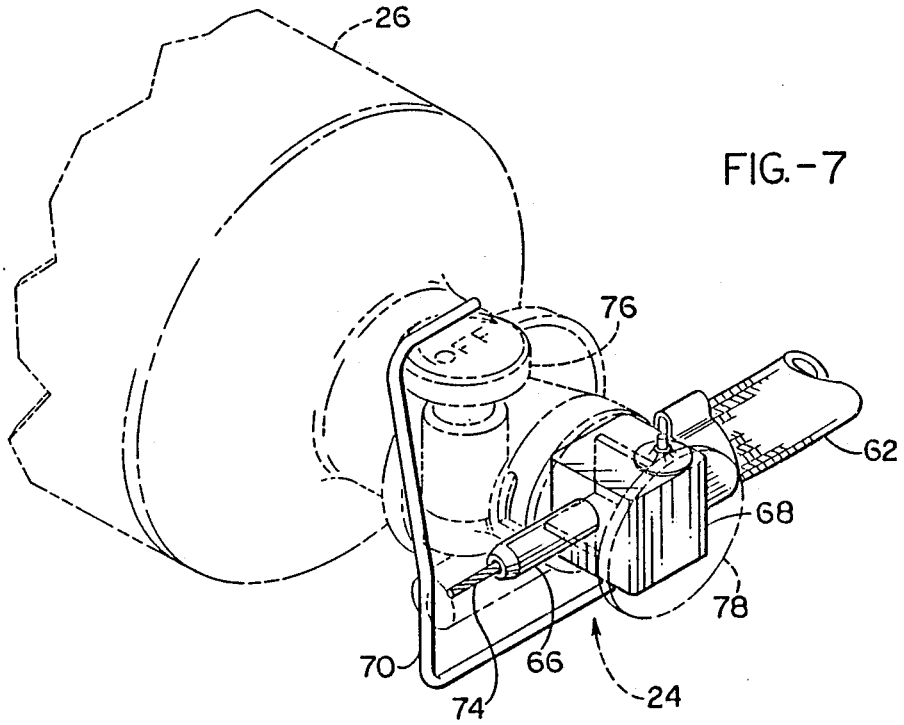
FIG. 7 is an enlarged perspective of the fuel conduit's distal end engaged with the MSR fuel vessel's pump, showing the alignment block properly seated and the swinging catch arm locked in place, said pump being shown in phantom.

Upper end plate 40 may be configured as shown in FIGS. 1 and 3 with hood 41 covering an air vent therein. Or, alternatively, the upper plate, and its hinge and clip, may be an integral unit disposed some distance above globe 44, thereby facilitating ventilation without a hood. In such an alternative arrangement, globe retaining means on end plate 38 may be necessary.

Liquid fuel-burning lighting means is disposed within said frame and globe. The preferred lighting means is adapted for use with white gas and comprises a fuel port 50 through lower end plate 38 connected to a pre-heat coil 52 in which fuel is vaporized. Fuel vapor passes from coil 52, up vertical vapor delivery tube 54 and through orifice 56 into mixing tube 58. One end of mixing tube 57 is mated with an aperture 58 through end plate 38; thus, tube 57 is open on one end to the ambient air. The other end of mixing tube 57 is unciform and supports a fabric mantle 59 where fuel is burned producing light.

In some applications, depending upon the dimensions of lantern head 10 and the relationship of its elements, pre-heat coil 52 may not be necessary. For example, if vapor delivery tube 54 is near enough to mantle 59 and the heat it generates, fuel may be vaporized as it travels upward toward orifice 56. In that case, the lower end of vapor delivery tube may simply mate with fuel port 50 to receive raw fuel.

Lantern head 10, as described, has two main elements which allow it to mate with the existing stove apparatus. First, an axial mounting bolt 60 depends from the center of the nether face of lower end plate 38. Bolt 60 needs only to be 2–3 centimeters long. Its diameter and thread spacing should match those of priming cup 20's threaded stem 32. For "MSR" stoves currently available, a 0.5 inch bolt having 20 threads per inch is necessary. Bolt 60, when engaged with threaded aperture 34 in the underside of the stove body, provides lantern head 10 with stable support.

Second, lantern head 10 has a fuel conduit 62 which carries fuel from the stove's fuel source. See, particularly, FIGS. 1, 3, 5, 6, and 7 illustrating the following. Fuel conduit 62, at its end proximal to lantern head 10, has a rigid metal leader tube 64 engaging fuel port 50. At its other, distal, end conduit 62 has apparatus matching that on the stove's fuel conduit 22 for engaging pump assembly 24. Said apparatus includes a rigid nozzle 66, a rectilinear alignment block 68 and a swinging catch arm 70 pivotally mounted in said block. Nozzle 66 fits into a cylindrical opening in pump assembly 24, and is sealed by an 0-ring set within said opening. Alignment block 68, rigidly bound behind nozzle 66, has one edge that aligns with a ridge 72 on pump assembly 24. If nozzle 66 and alignment block 68 are properly mated with the pump assembly, swinging catch arm 70 may be rotated through a 180° arc to bind the nozzle and block, and thus conduit 62, securely in place for safe and leak-free fuel transmission. Catch arm 70 settles in a groove, unnumbered, on the distal side of pump assembly 24.

Conduit 62 also has a filler cable 74 running through its full length, as does stove conduit 22, to act as a flow restrictor. Cable 74 also aids in scouring out deposits as they occasionally build up in the lumen of said conduit.

For further economy in design, lantern head 10 utilizes the fuel flow regulation means of stove 12. Said regulation means comprises a knurled thumbscrew 76 on pump assembly 24 having a valve therebeneath to vary the rate of fuel transmission in fuel conduit 62.

In use, conversion of an "MSR" stove, or the like, to a lighting device is a simple task. First, stove 12's fuel conduit 22 is disengaged from pump assembly 24 by swinging catch arm 70 out of its groove and withdrawing nozzle 66 from its cylindrical opening. Stove 12 is then inverted to rest in stable fashion upon its cooking vessel supports 30. Priming cup 20 may thereafter be unscrewed by hand to expose threaded aperture 34 in the stove's underside. Mounting bolt 60, depending from the nether face of lower end plate 38, may be screwed into said aperture to support lantern head 10 in upright fashion.

Once supported, lantern 10's fuel conduit 62 may be mated with the stove's pump assembly, fuel flow regulator and fuel supply. This is accomplished by inserting nozzle 66 in its opening and seating alignment block 68 against ridge 72. Catch arm is then swung to seat in its groove to the distal side of the pump assembly, binding fuel conduit securely in place.

Operation of the inventive lantern head begins by pressurizing the fuel supply in vessel 26 by reciprocating pump plunger 78 through several strokes, or cycles. Upon building up sufficient pressure, rotation of thumbscrew 76 permits fuel to travel through conduit 62, through leader tube 64, through port 50, up vapor delivery tube 54 to be emitted from orifice 56 into mixing tube 57 and, finally, to be burned at mantle 59.

The foregoing detailed disclosure of the inventive lantern head 10 is considered as only illustrative of the preferred embodiment of, and not a limitation upon the scope of, the invention. Those skilled in the art will envision many other possible variations of the structure disclosed herein. For example, many other means may be deployed beneath a lantern head to engage the underside of an inverted stove having a central body and outward-extending legs. Such stoves may burn butane or other fuels, but their structures may be such as to permit practice of the invention described herein if the lantern head is adapted to utilize the same fuel. And, alternative means for engaging the remote pump, fuel supply and flow regulator of a such a stove may also be devised. Further, many modifications directed to economizing the inventive lantern head's weight are contemplated, one such modification being the provision of apertures in the end plates. All these adaptations, nevertheless, fall within the scope of the following claims.

In addition, alternative uses for this inventive apparatus may later be realized. Accordingly, the scope of the invention should be determined with reference to the appended claims, and not by the examples which have herein been given.

I claim:

1. A lantern head for converting an inverted backpacking stove to a lantern, wherein said stove has outward-extending legs supporting a central body and wherein said stove draws from a remote fuel vessel, said lantern head comprising, in combination:

a. a frame;

b. a globe supported by said frame;

c. fuel-burning means for producing light mounted within said globe;

d. means for delivering fuel to said light producing means;

e. mounting means for supporting said frame above the underside of said inverted stove's central body; and, f. a fuel conduit having first and second ends wherein said conduit's first end is bound to said fuel delivery means, and wherein said second end has means for engaging a fuel vessel pump assembly, said assembly having an opening for a nozzle, a ridge for aligning an alignment block, and a groove for retaining a catch arm.

2. The lantern head of claim 1 wherein said fuel vessel engaging means includes an alignment block and swinging catch arm.

3. The lantern head of claim 1 wherein said mounting means comprises a threaded mounting bolt fixed to and projecting axially from beneath said frame.

4. A lantern head for converting a pressurized liquid fuel-burning camp stove to a lantern, wherein said stove has outward-extending legs supporting a central body, with a burner head mounted thereabove and a detachable priming cup therebelow and wherein said stove draws from a remote fuel vessel, said lantern head comprising, in combination:

a. a frame;

b. a globe supported by said frame;

c. fuel-burning means for producing light mounted within said globe;

d. means for delivering fuel to said light producing means;

e. mounting means for supporting said frame; and, f. a fuel conduit having first and second ends wherein said conduit's first end is bound to said fuel delivery means, and wherein said second end has means for engaging a fuel vessel pump assembly, said assembly having an opening for a nozzle, a ridge for aligning an alignment block, and a groove for retaining a catch arm.

5. The lantern head of claim 4 wherein said fuel vessel engaging means includes an alignment block and swinging catch arm.

6. The lantern head of claim 4 wherein said mounting means comprises a threaded mounting bolt fixed to and projecting axially from beneath said frame.

7. A lantern head for converting a camp stove to a lantern comprising, in combination:

a. a frame;

b. a globe supported by said frame;

c. fuel-burning means for producing light mounted within said globe;

d. means for delivering fuel to said light producing means;

e. mounting means for supporting said frame; and, f. a fuel conduit having first and second ends wherein said conduit's first end is bound to said fuel delivery means, and wherein said second end includes an alignment block and swinging catch arm.

8. The lantern head of claim 7 wherein said mounting means comprises a threaded mounting bolt fixed to and projecting axially from beneath said frame.

* * * * *